United States Patent [19]

Jones

[11] Patent Number: 4,669,126

[45] Date of Patent: Jun. 2, 1987

[54] ATHLETIC SOCK

[76] Inventor: Thomas L. Jones, 3 Indian Pl., Asheville, N.C. 28805

[21] Appl. No.: 906,885

[22] Filed: Sep. 15, 1986

[51] Int. Cl.[4] ..... A41D 13/00

[52] U.S. Cl. ..... 2/22; 2/239

[58] Field of Search ..... 2/22, 23, 239, 240, 2/241, 242

[56] References Cited

U.S. PATENT DOCUMENTS

| | | | |
|---|---|---|---|
| 536,322 | 3/1895 | Vernon | 2/242 X |
| 743,625 | 11/1903 | Douglas | 2/242 |
| 1,839,503 | 1/1932 | Russell | 2/242 |
| 2,814,807 | 12/1957 | Dollar | 2/239 |
| 4,001,953 | 1/1977 | Fugere et al. | 2/22 X |
| 4,008,350 | 2/1977 | Crawford et al. | 2/239 X |
| 4,306,315 | 12/1981 | Castiglia | 2/22 |

FOREIGN PATENT DOCUMENTS

| | | | |
|---|---|---|---|
| 2164472 | 12/1971 | Fed. Rep. of Germany | 2/22 |
| 2028141 | 1/1972 | Fed. Rep. of Germany | 2/22 |
| 2743741 | 9/1977 | Fed. Rep. of Germany | 2/22 |
| 1564324 | 3/1969 | France | 2/22 |
| 190992 | 9/1937 | Switzerland | 2/239 |

*Primary Examiner*—Stephen Marcus
*Assistant Examiner*—T. Graveline
*Attorney, Agent, or Firm*—B. B. Olive

[57] ABSTRACT

An improved athletic sock particularly intended for soccer incorporates a full leg sock over which is secured another partial sock structure between which the shin guard is nested.

2 Claims, 11 Drawing Figures

ATHLETIC SOCK

TECHNICAL FIELD

The present invention relates generally to socks for athletic wear and more particularly to a novel sock construction for use in sports activity in which the participant wears shin protection to protect from injury or the exaggeration of existing physical injury or ailments.

BACKGROUND ART

The current practice for participants in the sport of soccer is to utilize two pairs of socks to protect their legs from injury. One pair of socks under the pads and the other pair over the pads has proven to be quite unsatisfactory. This technique necessitates the wearing of soccer shoes which are oversized in order to accommodate the thickness due to the wearing of a second athletic sock over the foot area. Also, flexibility of the ankle which is required for playing soccer is substantially reduced.

U.S. Pat. Nos. 3,259,915, 4,282,728, 4,368,546 and 4,373,215 are illustrative of various sock constructions useful as background for the present invention.

DISCLOSURE OF INVENTION

In accordance with the present invention, applicant provides an athletic sock with a single foot portion and two leg portions stitched or knitted together. More specifically, the present invention provides a sock having a single foot portion and a double leg portion so that a shin guard may be worn over the inside sock portion and under the outside sock portion. This construction allows one leg portion to be pulled up adjacent to the leg between the leg and the shin pad to cushion the placement of the pad against the shin. The second leg portion is then pulled up over the shin pad. The single thickness of sock covering the foot allows the proper size shoe to be worn and permits flexibility of the ankles as demanded by the game of soccer.

The inner sock covers as a common knee sock while the outer sock is either knitted or sewn to the top of the foot portion of the inner sock. The outer sock in one embodiment has an open heel which allows the user to wear a shin pad with a heel strap as well as the type of shin pad that does not employ a heel strap. In an alternative embodiment, the heel of the outer sock is closed. With either embodiment, the socks can be separated except where stitched together when being washed which facilitates drying.

BEST MODE FOR CARRYING OUT THE INVENTION

Figure 2:
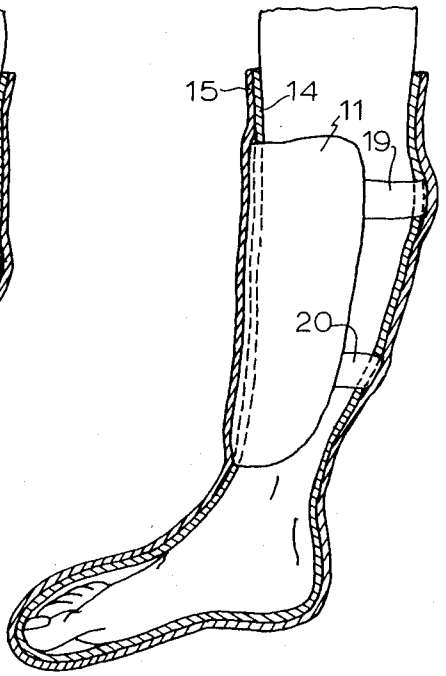
(PRIOR ART) FIG. 2
FIG. 2 is a sectional view of a prior art double sock arrangement similar to that of FIG. 1 but with a one-piece shin guard/pad arrangement.
Figure 1:
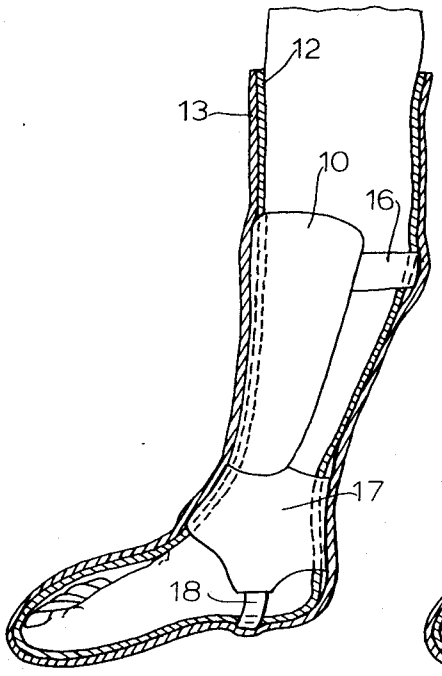
(PRIOR ART) FIG. 1
FIG. 1 is a sectional view of a prior art double sock arrangement with a shin pad having a strap which wraps under the heel.

Referring initially to FIGS. 1 and 2, two forms of shin pads 10, 11, respectively, are illustrated as presently used by soccer players. In both cases, a pair of socks 12, 13, and 14, 15, respectively, is used by the sports participant. In both arrangements, sock 12 or 14 is first pulled on by the user and conforms smoothly to the wearer's leg. After the respective sock 12 or 14 is in place, the wearer then places shin guard 10 or 11 in proper position on the wearer's leg on top of the respective sock 12 or 14. Guard 10 is of the type which fits over the shin and has a single strap 16 which goes around the user's calf. Guard 10 also has an ankle support portion 17 which in turn has a second strap 18 which passes around the wearer's heel. Guard 11 of FIG. 2 has a pair of straps 19, 20 which go around the wearer's calfs. As can be seen in FIGS. 1 and 2, the necessity of using two socks on each foot increases the bulk of the foot and necessitates the use of oversized shoes by the wearer. Further, the excessive thickness of two socks about the ankles greater reduces ankle flexibility and the ability to maneuver quickly during the game. Thus, an improved sock construction is needed which provides maximum flexibility yet adequate protection during use.

Figure 3:
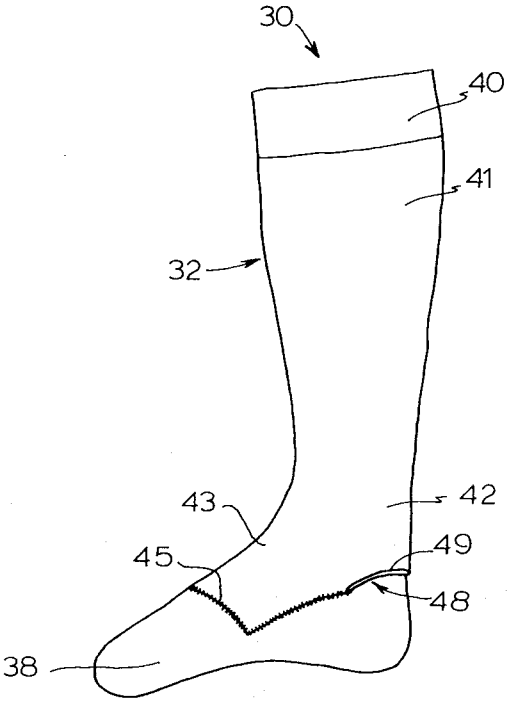
FIG. 3 is a side elevation view of the athletic sock of the present invention.
Figures 4, 5, 6, 7, 8, 9, 10, 11:
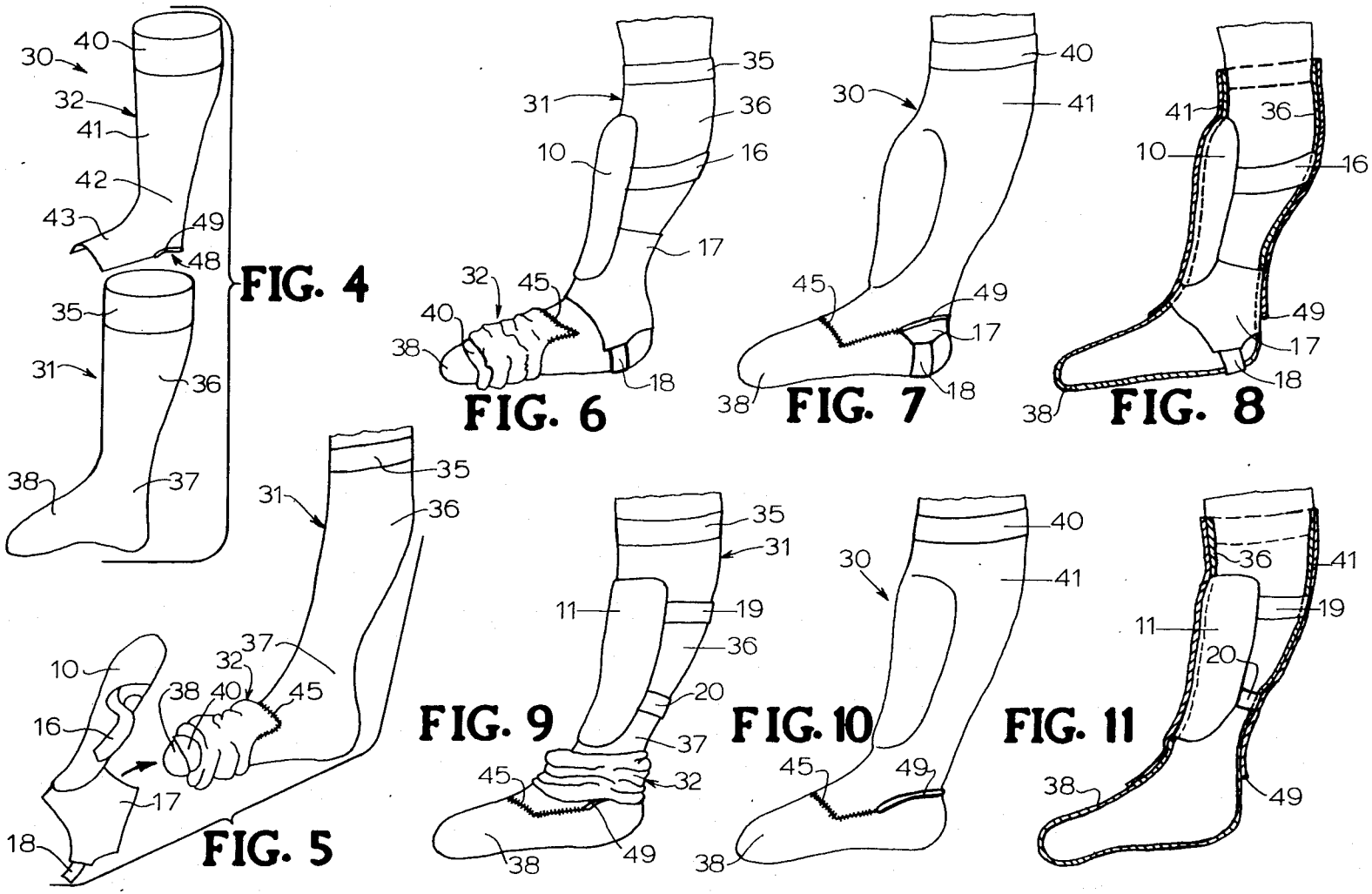
FIG. 4 is an exploded, pictorial view of the athletic sock of the invention illustrating the two leg portions in a non-united/unstitched condition.
FIG. 5 is an exploded side elevation view of the athletic sock of the invention showing the path of insertion of the foot into a shin guard with the ankle portion extending below the heel, and with the outer leg portion placed loosely about the toe portion of the foot ready to be pulled up into place.
FIG. 6 is a side elevation view of the athletic sock of the invention as used for soccer with the inner leg portion in place on the user's leg/foot, a shin guard in place with the ankle portion extending below the heel, and with the outer leg portion placed loosely about the toe portion of the foot ready to be pulled up into place.
FIG. 7 is a view similar to that of FIG. 6 but with the outer leg portion in place over the shin pad on the wearer's leg.
FIG. 8 is a sectional view of the athletic sock of the invention as mounted on the soccer player in FIG. 7.
FIG. 9 is a view similar to that of FIG. 6 but with a second form of shin pad in place and with the outer leg portion placed loosely about the upper foot and ankle ready to be pulled up into place.
FIG. 10 is a view similar to that of FIG. 7 but with the FIG. 9 shin pad arrangement.
FIG. 11 is a sectional view similar to that of FIG. 8 but with the second form of shin pad in place.

With the described shortcomings of the prior art in mind, applicant provides the improved athletic sock 30 seen in FIGS. 3–11. Sock 30 comprises a single, full length, tubular knit sock 31 and a second tubular knit partial sock portion 32. A relatively thick knit conventional athletic sock construction is preferred for sock 31 while a lighter, quicker drying fabric is preferred for sock 32. Sock 31 comprises cuff 35, leg portion 36, ankle portion 37, and foot portion 38 as best seen in FIG. 4.

Sock portion 32 comprises cuff 40, leg portion 41, ankle portion 42, and top foot portion 43. Sock portions 31 and 32 are either stitched or knitted together as illustrated in the drawings by stitching 45. Thus, sock 31 and leg portion 32 may be separated, except where stitched together, when being washed to facilitate drying. Noticeably, sock portion 32 comprises a single thickness of fabric.

During fabrication of athletic sock 30, sock portion 32 is pulled down over sock 31 so that the top foot portion 43 is positioned as in FIG. 3. Top foot portion 43 is then knitted or stitched to foot portion 38 by stitches 45. In a first embodiment illustrated in FIG. 3, stitches 45 only extend around the front and sides of foot portion 38. Thus, once foot portion 38 and top foot portion 43 are assembled, a heel portion slot or opening 48 (FIG. 3) is provided between sock portion 32 and sock 31. In this first embodiment, the fabric edge on the top foot portion 43 forming the slot 48 is preferably stitched and covered by an elastic band 49 which both prevents fraying and restrains sock 32 from riding up on sock 31. In a second embodiment, not illustrated, for use with a shin pad of the type which does not employ a heel strap, stitching 45 extends completely around the front, sides and rear of foot portion 38 and thus does not provide the mentioned slot 48.

In use, the wearer of athletic sock 30 pulls leg portion 32 down into the position seen in FIG. 5 and then sock portion 31 is pulled onto the wearer's leg. Next, the shin pad, either pad 10 or pad 11 is placed on the wearer's leg. If pad 10 is used, then the strap 18 is passed under the wearer's heel as in FIG. 6. Next, sock portion 32 is pulled up over shin pad 10. With sock portion 31 adjacent the leg of the wearer and with shin guard 10 on top thereof, the leg is cushioned from the pad. Alternatively, if shin pad 11 is used, the same steps are followed as illustrated in FIGS. 9–11 except that strap 18 would, of course, not be used. Also to be noted is that when shin pad 11 is used, the slot 48 is not required and thus the stitching 45 can extend completely around the sides and rear of foot portion 38.

From the foregoing, it can thus be seen that a substantially improved athletic sock has been provided with enhanced protection and flexibility. Oversized shoes are no longer required.

In the drawings and specification, there has been set forth a preferred embodiment of the invention, and although specific terms are employed, they are used in a generic and descriptive sense only and not for purposes of limitation, the scope of the invention being defined in the claims.

What is claimed is:

1. An athletic sock, comprising:

(a) a first tubular knit sock having foot, ankle, leg and cuff portions; and (b) a second tubular knit partial sock having a partial ankle portion at least partially secured to the sides and top of said first sock foot portion, a leg portion overlying said first sock leg portion and a cuff portion, said first sock and second sock leg portions forming a receptacle therebetween surrounding the leg of the wearer and sized for receiving a shin guard secured to the leg of the wearer by strap means encircling said first sock leg portion and including a heel strap with said shin guard including said strap means being covered by said second sock leg portion wherein said second sock ankle portion is secured in a manner to provide a rearwardly disposed opening between said first and second sock ankle portions for receiving said heel strap to secure said shin guard.

2. A protective athletic leg assembly comprising:

(a) an athletic sock comprising:

(i) a first tubular knit sock having foot, ankle, leg and cuff portions; and (ii) a second tubular knit partial sock having a partial ankle portion at least partially secured to the sides and top of said first sock foot portion, said second sock ankle portion being secured in a manner to provide a rearwardly disposed opening between said first and second sock ankle portions for receiving a heel strap to secure a shin guard, a leg portion overlying said first sock leg portion and a cuff portion, said first sock and second sock leg portions forming a receptacle therebetween surrounding the leg of the wearer and sized for receiving a shin guard secured to the leg of the wearer by strap means encircling said first sock leg portion and with said shin guard including said strap means being covered by said second sock leg portion; and (b) a shin guard having said leg securing strap means nested between said first and second sock leg portions, secured to the leg of the wearer by said strap means encircling said first sock leg portion and with said shin guard including said strap means being covered by said second sock leg portion said shin guard including a heel strap adapted to secure said shin guard by being passed under the heel of the wearer through said opening.

* * * * *